US012460511B2

(12) United States Patent
Olander

(10) Patent No.: US 12,460,511 B2
(45) **Date of Patent: *Nov. 4, 2025**

(54) DRILL STEM GREASING DEVICE AND METHOD

(71) Applicant: TT Technologies, Inc., Aurora, IL (US)

(72) Inventor: John A. Olander, Clayton, WI (US)

(73) Assignee: TT Technologies, Inc., Aurora, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/662,048

(22) Filed: May 13, 2024

(65) Prior Publication Data

US 2024/0295163 A1 Sep. 5, 2024

Related U.S. Application Data

(63) Continuation of application No. 17/390,051, filed on Jul. 30, 2021, now Pat. No. 11,988,073.

(60) Provisional application No. 63/065,661, filed on Aug. 14, 2020.

(51) Int. Cl.

| | |
|---|---|
| ***E21B 41/00*** | (2006.01) |
| ***E21B 7/04*** | (2006.01) |
| ***E21B 19/16*** | (2006.01) |

(52) U.S. Cl.

CPC ..... *E21B 41/00* (2013.01); *E21B 7/04* (2013.01); *E21B 19/16* (2013.01)

(58) Field of Classification Search

CPC ..... E21B 19/16; E21B 41/00; E21B 7/04

See application file for complete search history.

(56) References Cited

U.S. PATENT DOCUMENTS

| | | | | |
|---|---|---|---|---|
| 4,199,858 | A | 4/1980 | Meijs | |
| 6,179,065 | B1 | 1/2001 | Payne et al. | |
| 10,576,596 | B2 * | 3/2020 | Bangma | F16N 13/22 |
| 10,682,748 | B2 * | 6/2020 | Moore | F16N 7/36 |
| 11,988,073 | B2 * | 5/2024 | Olander | E21B 41/00 |
| 2006/0231261 | A1 | 10/2006 | Tjader | |
| 2010/0230115 | A1 | 9/2010 | Belik | |
| 2012/0043163 | A1 | 2/2012 | Jagdale et al. | |
| 2012/0247876 | A1 | 10/2012 | Kreutzkämper et al. | |
| 2016/0046009 | A1 | 2/2016 | Moore | |
| 2016/0362943 | A1 | 12/2016 | Malstam et al. | |
| 2017/0113315 | A1 | 4/2017 | Bangma et al. | |

(Continued)

FOREIGN PATENT DOCUMENTS

| | | | |
|---|---|---|---|
| CN | 111774866 | A | 10/2020 |
| WO | WO-2022061459 | A1 | 3/2022 |

OTHER PUBLICATIONS

"U.S. Appl. No. 17/390,051, Non Final Office Action mailed Sep. 14, 2023", 8 pgs.

(Continued)

*Primary Examiner* — Daniel P Stephenson

(74) *Attorney, Agent, or Firm* — Schwegman Lundberg & Woessner, P.A.

(57) ABSTRACT

A drill stem grease injector for a directional drill and associated methods are disclosed. Example drill stem grease injectors include a piston within an injection chamber, and a grease port in a side of the injection chamber, wherein grease port is configured to actuate before motion of the piston during an injection operation. Drill stem grease systems shown provide refill capabilities that reduce or eliminate a user's need to touch grease.

18 Claims, 7 Drawing Sheets

(56) References Cited

U.S. PATENT DOCUMENTS

| | | | | |
|---|---|---|---|---|
| 2019/0184540 | A1 | 6/2019 | Moore | |
| 2022/0049583 | A1 | 2/2022 | Olander | |
| 2024/0295163 | A1* | 9/2024 | Olander | E21B 41/00 |

OTHER PUBLICATIONS

"U.S. Appl. No. 17/390,051, Notice of Allowance mailed Jan. 19, 2024", 8 pgs.
"U.S. Appl. No. 17/390,051, Response filed Dec. 14, 2023 to Non Final Office Action mailed Sep. 14, 2023", 9 pgs.

* cited by examiner

DRILL STEM GREASING DEVICE AND METHOD

PRIORITY

This application is a continuation of U.S. patent application Ser. No. 17/390,051, filed Jul. 30, 2021, which claims the benefit of priority to U.S. Provisional Application Ser. No. 63/065,661, filed Aug. 14, 2020, all of which are incorporated by reference herein in their entirety.

TECHNICAL FIELD

Embodiments described herein generally relate directional drills and associated methods.

BACKGROUND

Directional drilling involves the assembly and disassembly of a plurality of drill stem segments. The couplings between drill stem segments are typically threaded, and subject to the harsh environment of underground operation. It is useful to grease threaded connections at drill string joints to provide secure connections when in use, and to facilitate easier disassembly when retracting a drill string. Greasing devices are frequently mounted on directional drills for convenient and consistent greasing of joints. The grease used can be quite thick, and difficult to handle. Further it is difficult to clean up after any personal contact with grease by an operator. Improved devices and methods are desired for drill stem greasing that addresses these and other concerns.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
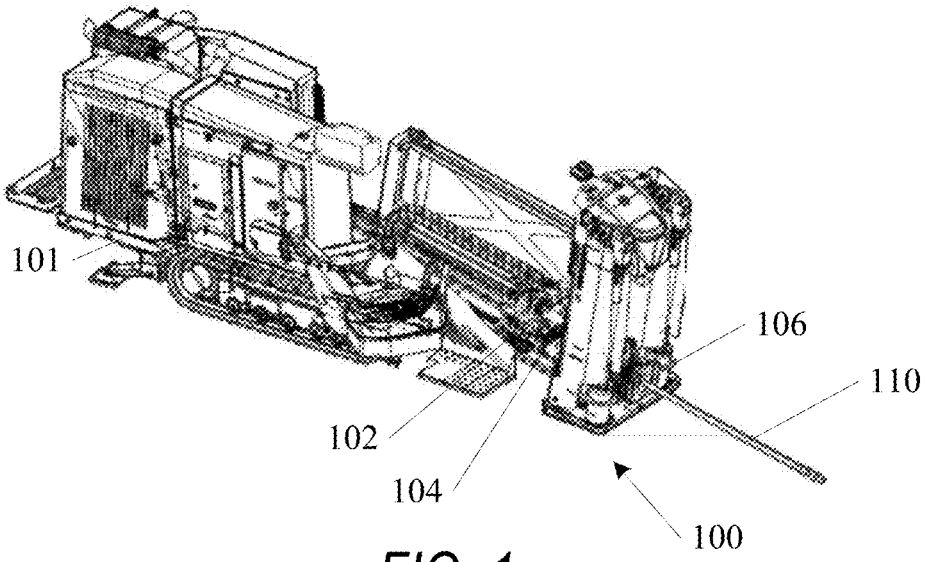
FIG. 1 shows a directional drill in accordance with some example embodiments.

FIG. 1 shows an example of a directional drill 100. The directional drill 100 includes a drive motor 102 mounted on a sliding carriage 104. The sliding carriage 104 is adapted to move back and forth on a drill frame 101. A drill stem vice 106 is shown located at a front end of the drill frame 101. A section of drill stem 110 is shown coupled to the drive motor 102, and passing through the drill stem vice 106.

Figure 2:
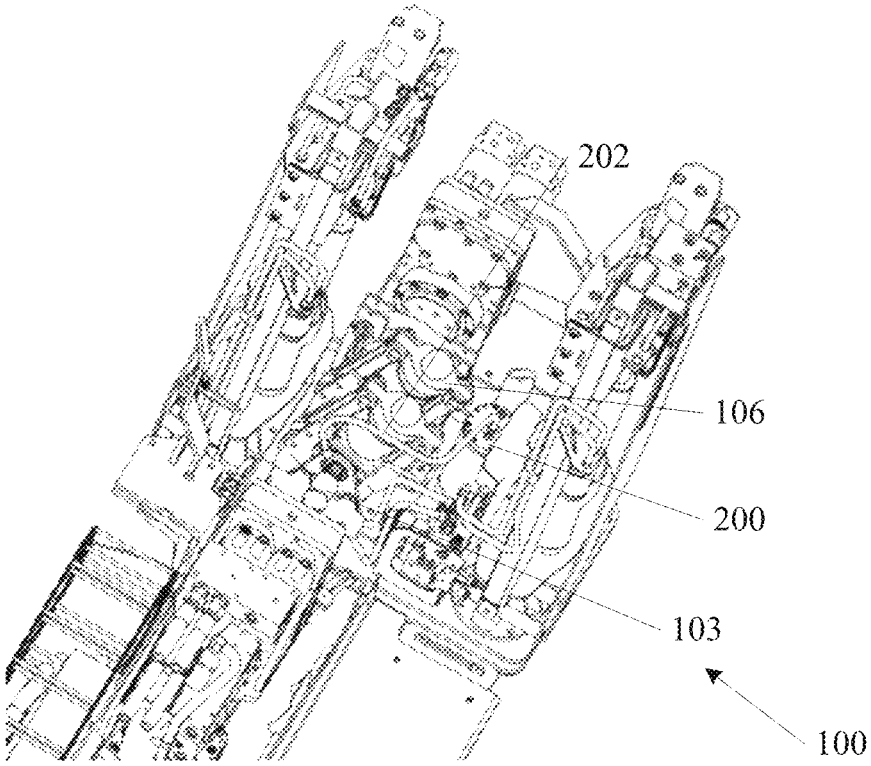
FIG. 2 shows selected portions of a directional drill in accordance with some example embodiments.

FIG. 2 shows selected portions of the directional drill 100 from FIG. 1. FIG. 2 further shows a drill stem grease system 200 coupled adjacent to the drill stem vice 106. A tube 202 is shown extending from the drill stem grease system 200 to a location adjacent to one set of jaws of the drill stem vice 106. In operation, drill stem segments will pass through jaws of the drill stem vice 106. A location adjacent to jaws of the drill stem vice is therefore a good place to grease connection threads of drill stem segments.

In one example, a sub saver 103 is defined as a drill stem thread that is greased. In operation, the sub saver 103 is coupled to the drive motor 102 as shown in FIG. 1. The sub saver 103 is used over an over to insert and/or remove each drill stem segment. In operation, when grease is applied to threads on the sub saver 103, some of the grease on the sub saver 103 is then transferred to each drill string segment being driven by the sub saver 103 and the drive motor 102. In this way, all drill stem segments in a drill string will receive some of the grease applied to the sub saver as each successive drill string segment is driven into the ground. Although applying grease to the sub saver 103 is used as an example, the invention is not so limited. In other examples, grease is applied to the threads of each drill string segment directly as they are added to the drill string.

Figure 3:
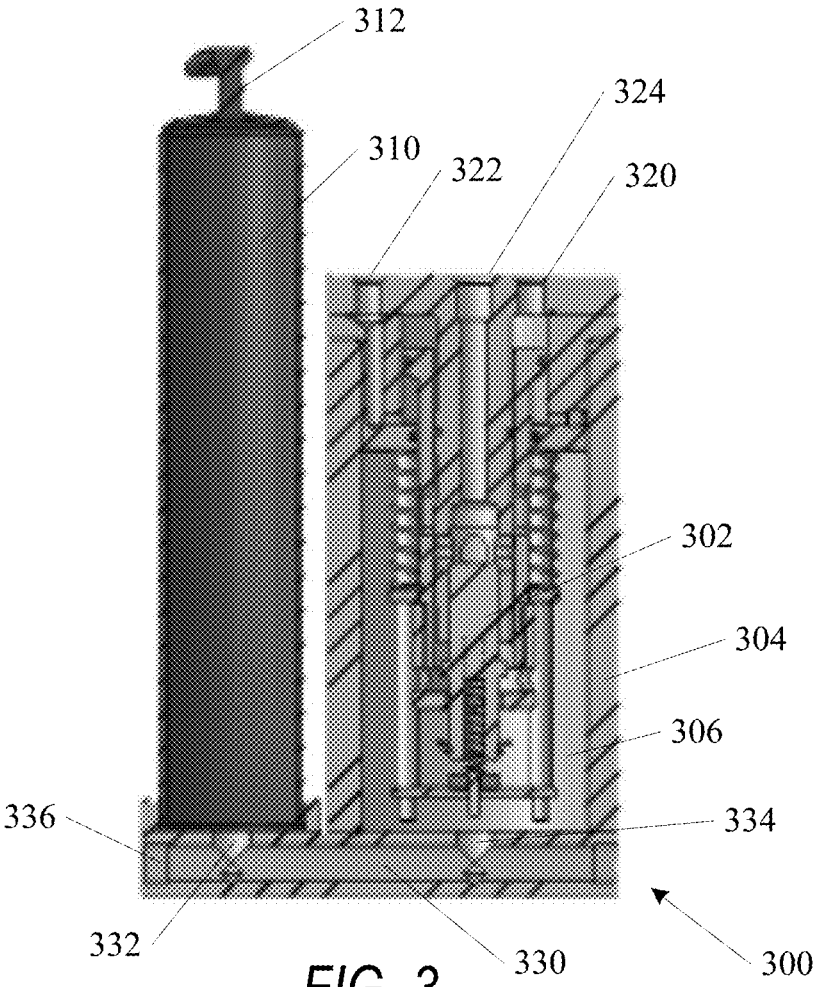
FIG. 3 shows a drill stem grease system in accordance with some example embodiments.

FIG. 3 shows one example of a drill stem grease system 300 for use with a directional drill, such as directional drill 100 from FIGS. 1 and 2. The drill stem grease system 300 includes a drill stem grease injector 302 located within a housing 304. The housing 304 is coupled to a grease reservoir 310. The grease reservoir 310 is shown coupled to the drill stem grease injector 302 through a refill passage 330. In the example shown, the refill passage 330 include a reservoir port 332, and a second port 334 to the drill stem grease injector 302.

In one example, a grease cartridge such as a cardboard tube filled with grease, may be separately purchased and exchanged with a spent grease cartridge in the grease reservoir 310. A handle 312 is shown that may be coupled to a plunger. The handle and plunger may be drawn back and removed to open the grease reservoir. A spent grease cartridge may then be removed, and a fresh grease cartridge installed. Once installed, the handle 312 and plunger may be reinstalled to seal the grease reservoir 310. In one example, a spring is coupled to the handle 312 that applies pressure to an end of the grease cartridge and presses grease out of the grease reservoir and into the refill passage 330.

Although a cartridge may be used, the invention is not so limited. In one example, the grease reservoir 310 may be filled with or without a cartridge. Further, in one example, a refill port 336 is further shown at one end of the refill passage 330. In one example, grease from a separately purchased bucket may be filled into the grease reservoir 310 through the refill port 336. In one example, a threaded plug may be removed from the refill port 336 for access during filling, and the threaded plug may be replaced after refilling the grease reservoir 310. In one example, a refill grease bucket may include a supply hose that can be coupled to the refill port 336. In this way, a directional drill operator need not touch any grease when refilling the grease reservoir 310. This is desirable, as drill stem grease may be quite sticky with an unpleasant smell.

In addition to grease stored in the grease reservoir 310, the housing 304 of the drill stem grease system 300 may include a space 306 between the drill stem grease injector 302 and the housing 304 that fills with grease. In such an example, the space 306 may be considered to be a grease reservoir, or a part of a grease reservoir in combination with reservoir 310 or other additional grease holding structures. In operation, hydraulic actuation through ports 320 and 322 operate the drill stem grease injector 302. In the example shown, grease is expelled through exit port 324. More detailed operation of selected examples of a drill stem grease injector is discussed below and in FIGS. 4A-D.

Examples of drill stem grease injectors as described provide a number of advantages, including reduced or eliminated cavitation of grease during an injection operation. If grease in a grease injector cavitates, the grease may cease to flow as desired, and the injector may need to be re-primed to continue operation. By removing or reducing cavitation of grease, the reliability of continuous operation of the drill stem grease injector is improved.

Figure 4A:
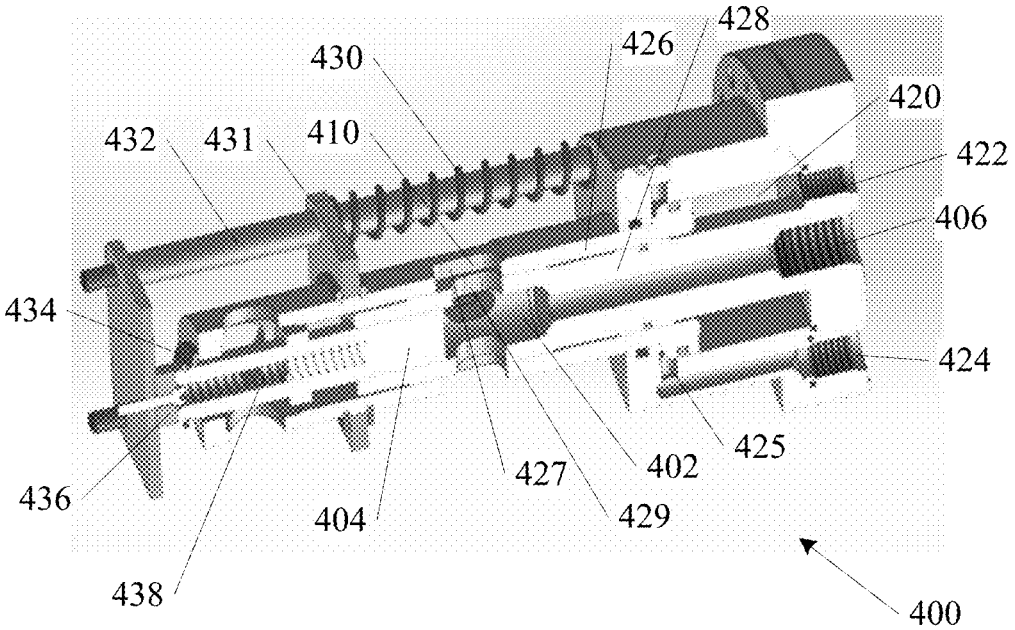
FIG. 4A shows a cross section of a drill stem grease injector in operation in accordance with some example embodiments.

FIG. 4A shows a drill stem grease injector 400 in a reset position, ready to inject an amount of grease out of exit port 406. The injector 400 includes an injection chamber 402, and a piston 404 movable within the injection chamber 402. A grease port 410 is shown in a side of the injection chamber 402. The grease port 410 is configured to actuate open or closed before motion of the piston 404 during operation.

In one example, the drill stem grease injector 400 is hydraulically actuated, although the invention is not so limited. Other examples include, but are not limited to, mechanical actuation, solenoid actuation, electric motor actuation, etc. A first hydraulic port 422 and a second hydraulic port 424 are shown in communication with a hydraulic piston 425 to drive operation of the injector 400.

In the example shown, the injection chamber 402 includes a first cylinder 428. A second cylinder 426 is configured with a close fit to slide back and forth over the first cylinder 428. A first opening 429 in the first cylinder 428 and a second opening 427 in the second cylinder 426 may be aligned to permit flow of grease, or moved out of alignment, to close off the grease port 410. In the example shown, the second cylinder 426 is driven by the hydraulic piston 425.

In the example shown, a brace member 431 guides the second cylinder 426 along guide rods 432. A number of return springs 430 are shown located over the guide rods 432 to make the second cylinder 426 normally in a reset position to the left of FIG. 4A as shown in FIG. 4A. Actuation of the hydraulic piston 425 drives against the return springs 430, and upon release of hydraulic pressure on port 424, the return springs 430 will pull the second cylinder 426 back to the reset position shown in FIG. 4A.

A spring washer 434, such as a Belleville washer is coupled to an end of the piston 404, and provides a soft stop for a back portion of the second cylinder 426. A magnet 436 is shown that holds the piston 404 in place until actively pulled by the second cylinder 426 as described in more detail below. An internal spring 438 is further shown to urge the piston to the right side of FIG. 4A once the piston 404 is fee of the magnet 436.

A combination of elements such as the magnet 436 and the internal spring 438 provide a desired sequence of events that do not require complicated and expensive hydraulic valves, or a number of complicated and expensive separate actuators. The sequence of events, as described in more detail below, provide an injector 400 that reduces or eliminates cavitation of grease during operation at a reduced cost, and with a high degree of reliability due to reduction in complicated and expensive components.

Figure 4B:
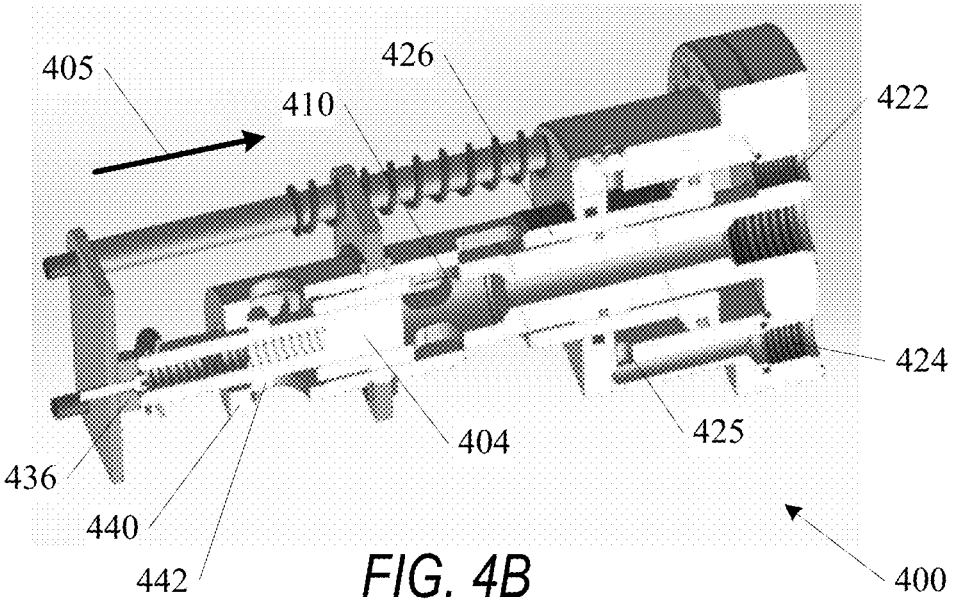
FIG. 4B shows a cross section of a drill stem grease injector in operation in accordance with some example embodiments.

FIG. 4B shows the drill stem grease injector 400 in an intermediate stage of an injection operation. In FIG. 4B, the second cylinder 426 has been driven a distance to the right along arrow 405 by hydraulic piston 425. A lip 440 on a back portion of the second cylinder 426 is shown contacting a ledge 442 of the piston 404. Because of the motion to the right along direction 405, the grease port 410 is now illustrated in a closed condition. As illustrated in FIG. 4B, the grease port 410 closes before any motion of the piston 404. In one example, to ensure that the grease port 410 closes before any motion of the piston 404, the magnet 436 holds the piston 404 in place until the lip 440 contacts the ledge 442.

Figure 4C:
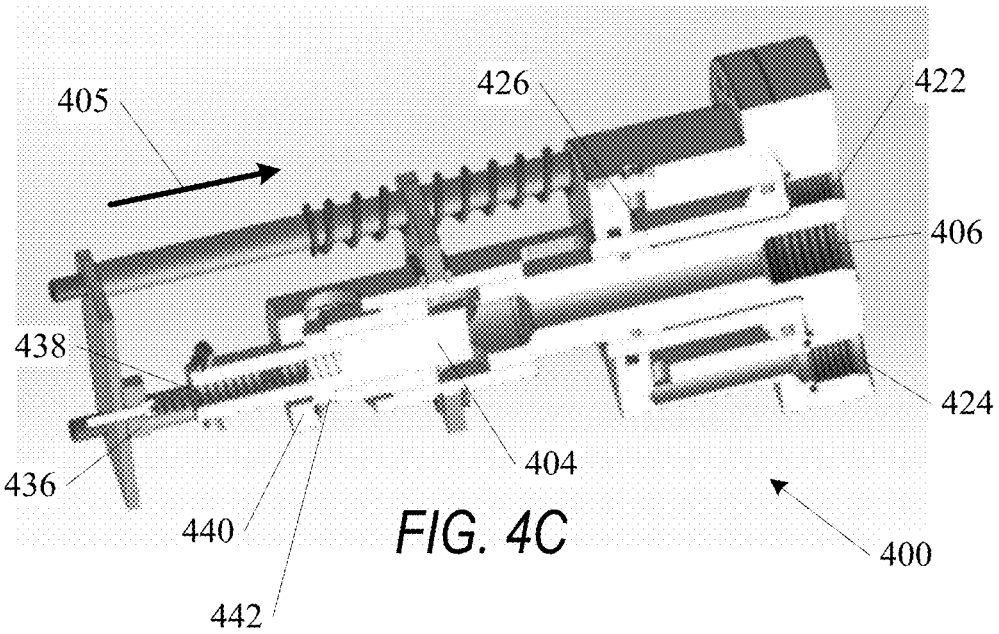
FIG. 4C shows a cross section of a drill stem grease injector in operation in accordance with some example embodiments.

FIG. 4C shows the drill stem grease injector 400 in another stage of an injection operation. The hydraulic piston 425 continues to drive the second cylinder 426 to the right along direction 405. The lip 440 on the back portion of the second cylinder 426 is shown pulling against the ledge 442, and the piston 404 is now pulled to inject grease within the injection chamber 402 out through the exit port 406. The grease port 410 still remains closed, as in the previous FIG. 4B. At the end of the operation in FIG. 4C, the internal spring 438 urges the piston 404 to the right of the Figure, now that the piston 404 is broken free of the magnet 436. By closing the grease port 410 before motion of the piston 404, cavitation of grease is reduced or eliminated. Only an amount of grease secured within the injection chamber 402 by the closed grease port 410 is subject to pressure from the piston 404.

Figure 4D:
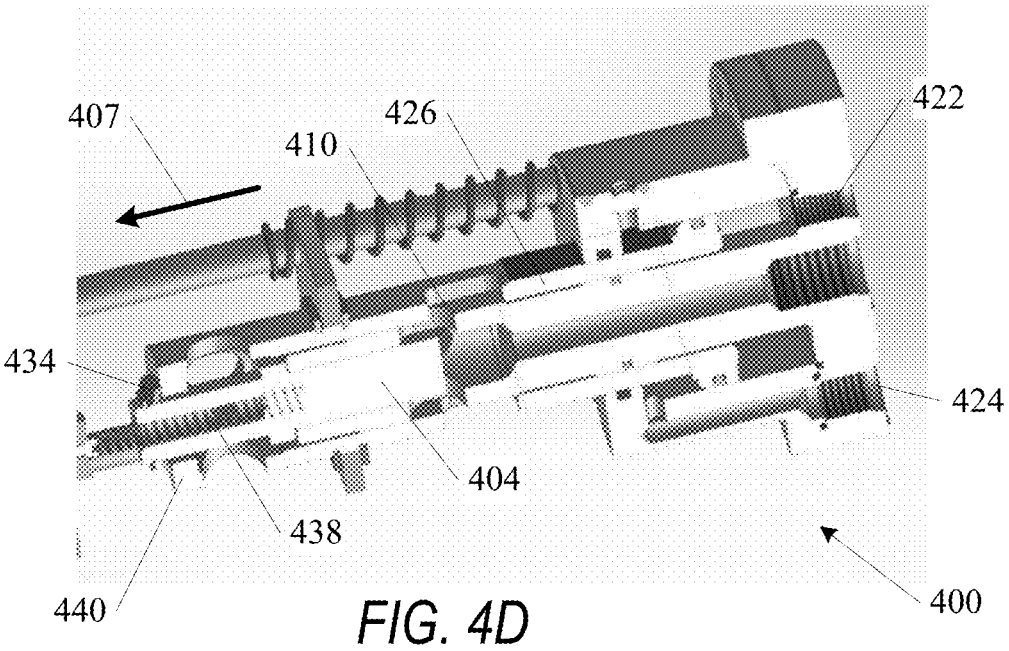
FIG. 4D shows a cross section of a drill stem grease injector in operation in accordance with some example embodiments.

FIG. 4D shows the drill stem grease injector 400 in another stage of an injection operation. A grease injection from exit port 406 has been accomplished, and the hydraulic piston 425 now drives the second cylinder 426 to the left along direction 407. As discussed above, in one example the return springs 430 may provide all or a part of the force that drives the second cylinder 426 to the left of the Figure. In one example, the hydraulic piston 425 drives some or all of the force that drives the second cylinder 426 to the left of the Figure. In one example, the internal spring 438 holds the piston 404 in place to the right of the Figure until the lip 440 of the second cylinder 426 contacts the Bellville washer 432. As shown in FIG. 4D, the grease port 410 is at least partially open before the lip 440 contacts the washer 432. In this way, it is ensured that the grease port 410 is actuated open before motion of the piston 404 to the left along arrow 407. As the lip 440 of the second cylinder 426 continues to travel to the left along arrow 407, it pushes the washer 432, and in turn pushes the piston 404. At the end of the operation stage illustrated in FIG. 4D, the injector 400 returns to the reset condition shown in FIG. 4A.

In the examples shown, the function of the magnet 436 and the internal spring 438 ensure that the grease port 410 is actuated before motion of the piston 404 during both motion of the piston 404 to the right, and to the left as illustrated in the FIGS. 4A-4D. As described above, the grease port 410 closes before piston 404 motion to the right, and the grease port 420 opens before piston 404 motion to the left. Although this configuration is efficient and cost effective, the invention is not so limited. Other linkages, sequence devices, electronic components, etc. may be used within the scope of the invention to ensure that the grease port 410 is actuated before motion of the piston 404.

Figure 5:
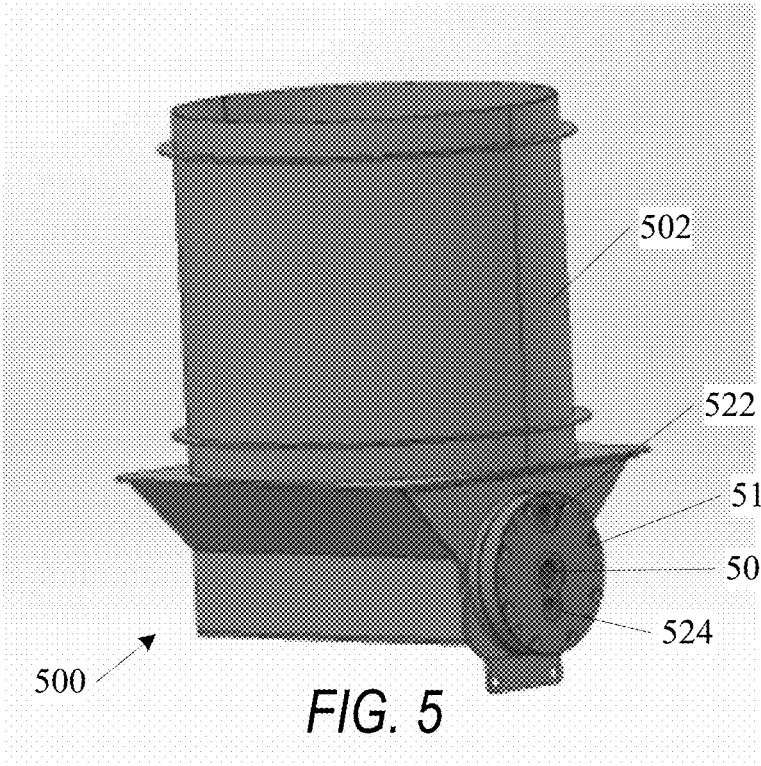
FIG. 5 shows a drill stem grease injector in accordance with some example embodiments.
Figure 6:
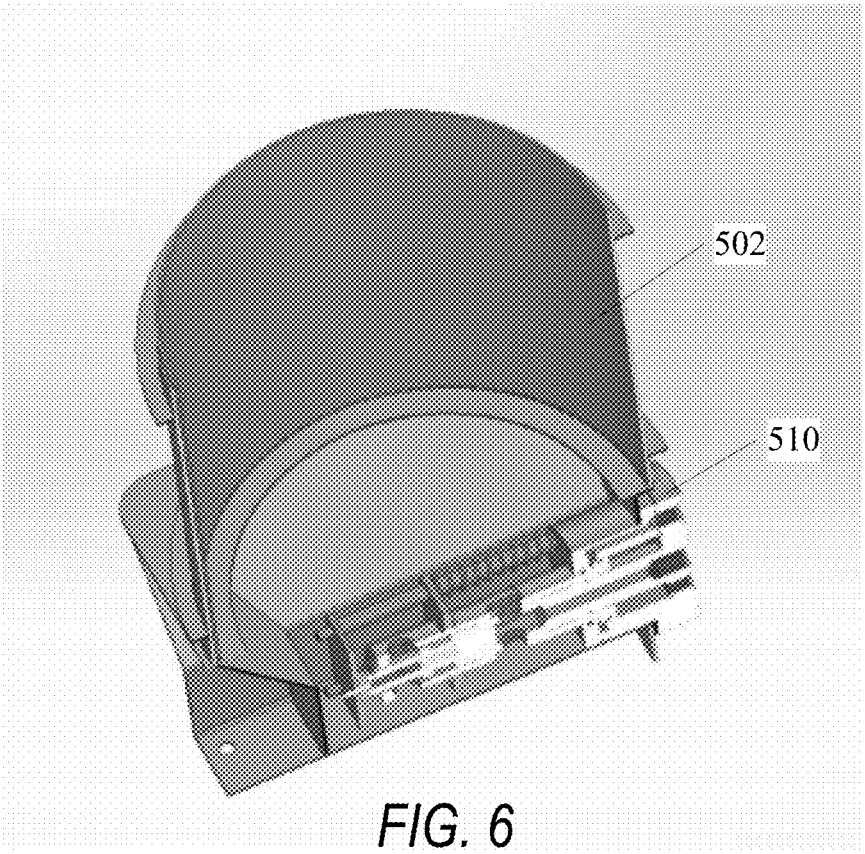
FIG. 6 shows cross section of the drill stem grease injector from FIG. 5 in accordance with some example embodiments.

FIG. 5 shows a drill stem grease system 500 according to one example. A drill stem grease injector 510 is shown coupled to a hopper 502. In one example, the drill stem grease injector 510 is similar to the injector 400 described in FIGS. 4A-4D. A first hydraulic port 322 and a second hydraulic port 324 are shown, along with an exit port 506. FIG. 6 shows a cross section of the drill stem grease system 500 from FIG. 5. In operation, grease flows downward by gravity inside the hopper 502 and immerses the drill stem grease injector 510. Preventing or reducing cavitation of grease in a hopper example is especially important as there is no additional pressure on the grease apart from gravity to maintain a primed drill stem grease injector 510. Example drill stem grease injectors as described above reduce or eliminate cavitation due to a grease port that is configured to actuate open or closed before motion of the piston.

Figure 7:
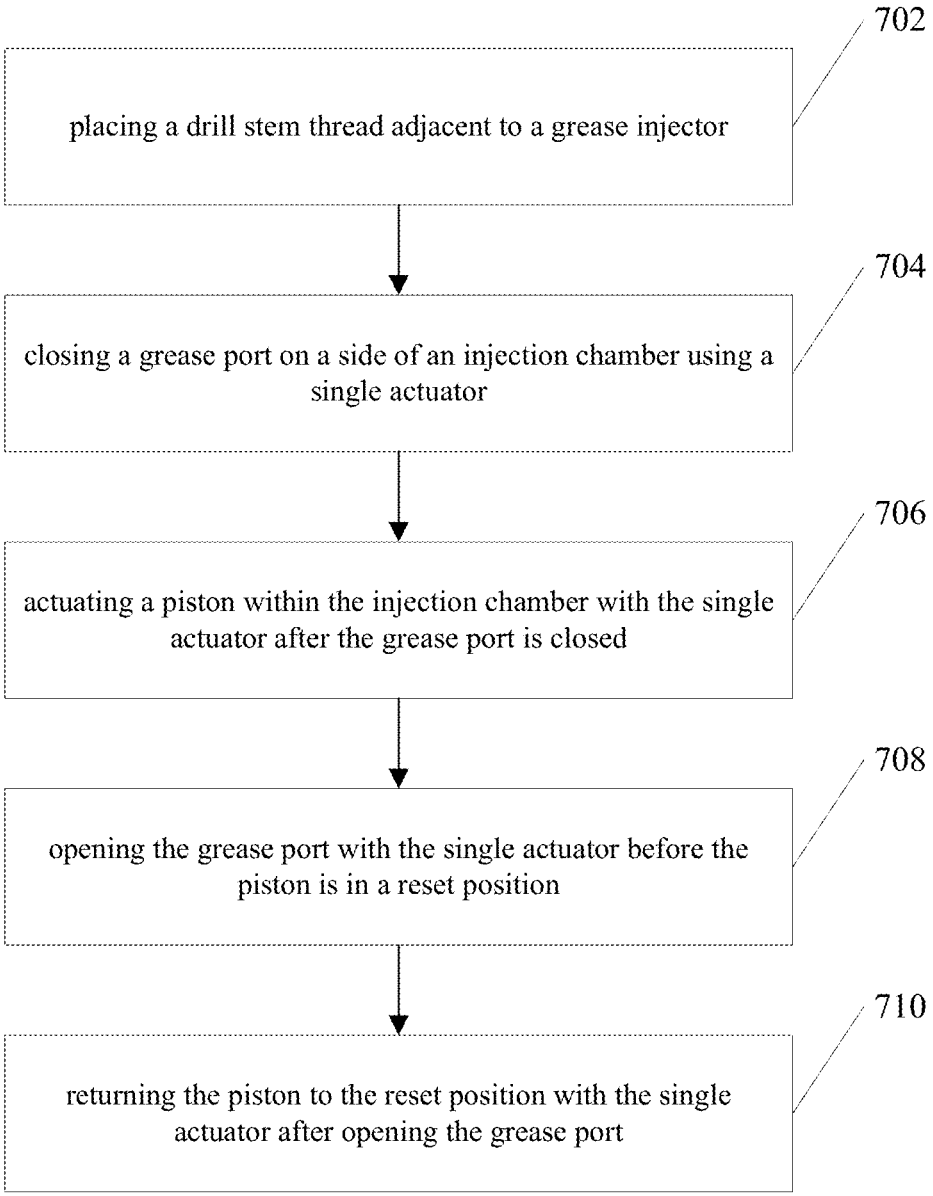
FIG. 7 shows a flow diagram of a method of operating a drill stem grease injector in accordance with some example embodiments.

FIG. 7 shows a flow diagram of an example method of operation of a drill stem grease injector. In operation 702, a drill stem thread is placed adjacent to a grease injector. In operation 704, a grease port is closed on a side of an injection chamber using a single actuator. In operation 706, a piston is actuated within the injection chamber with the single actuator after the grease port is closed. In operation 708, the grease port is opened with the single actuator before the piston is in a reset position, and in operation 710, the piston is returned to the reset position with the single actuator after opening the grease port.

Figure 8A:
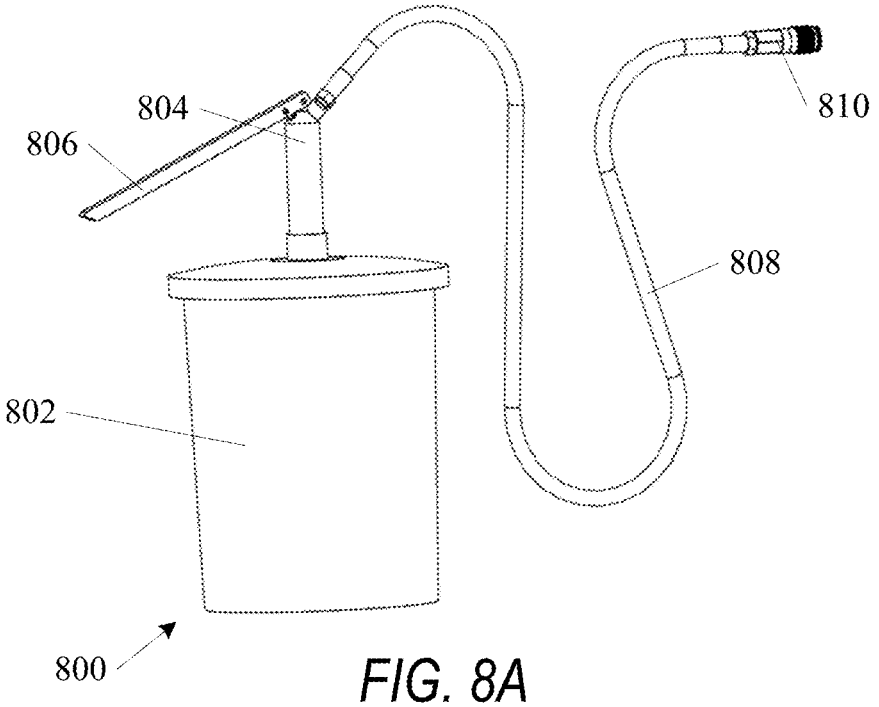
FIG. 8A shows a grease refill supplier in accordance with some example embodiments.
Figure 8B:
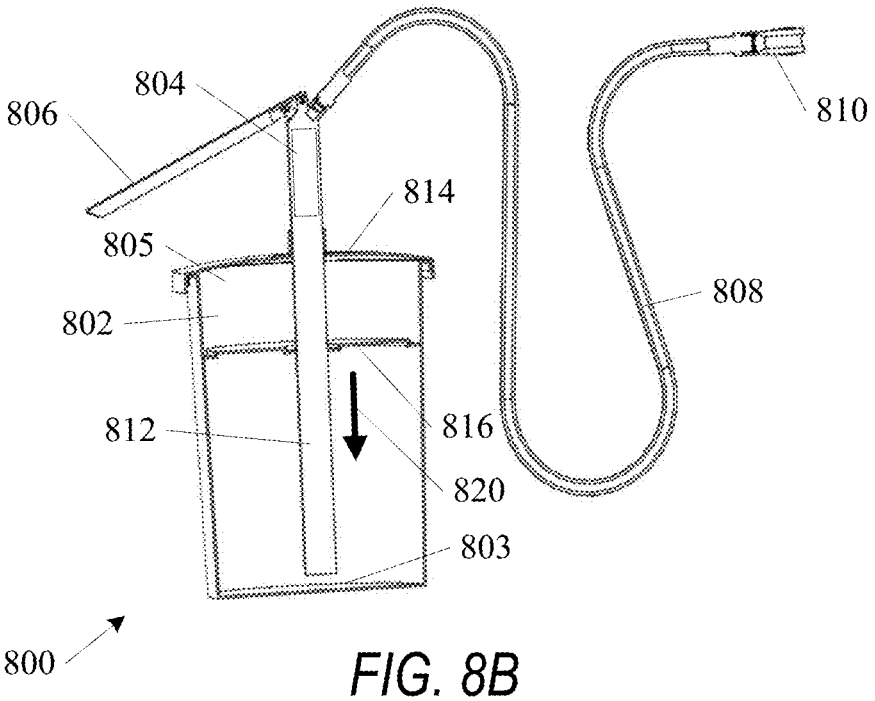
FIG. 8B shows a cross section view of the grease refill supplier from FIG. 8A in accordance with some example embodiments.

FIGS. 8A and 8B show an example of a grease refill supplier 800. In one example, the grease refill supplier 800 is adapted for use with drill stem grease systems as described in examples above. The grease refill supplier 800 shown in FIG. 8A includes a refill reservoir 802 sized to hold multiple refill amounts for a drill stem grease system. In one example, the refill reservoir 802 is sized to hold multiple refill amounts for grease reservoir 310 shown in FIG. 3. As noted above, drill stem grease can be sticky and can have an unpleasant smell. By sizing the refill reservoir 802 large enough to hold multiple refills of the grease reservoir 310, any handling or refilling of grease is reduced. The grease refill supplier 800 can be operated multiple times to fill a grease reservoir such as grease reservoir 310 before any refilling or replacement of the refill reservoir 802.

The grease refill supplier 800 further includes a refill pump 804 and a refill pump actuator 806 coupled to the refill pump 804. In the example of FIG. 8, the refill pump actuator 806 is a hand actuator, such as a handle. Other hand actuators are possible, such as a crank wheel, or a pressed piston. In one example, the refill pump actuator 806 is powered, such as by an electric motor, or by hydraulic power provided by an auxiliary connection to the directional drill.

The grease refill supplier 800 further includes a refill hose 808 coupled to an outlet of the refill pump 804. A fitting 810 is included on a distal end of the refill hose 808. The fitting 810 is configured to uniquely connect to a refill passage of a reservoir on the directional drill. In the example of FIG. 3, the fitting 810 is uniquely configured to couple to the refill port 336. In one example, the fitting 810 and corresponding refill port 336 include threaded couplings. In one example, the fitting 810 and corresponding refill port 336 include a quick connect collar fitting. In one example, the fitting 810 and corresponding refill port 336 include a friction fit. In one example, the fitting 810 and corresponding refill port 336 include a grease zerk fitting and coupler. Other fitting and port configurations are also within the scope of the invention.

FIG. 8B shows a cross section of the grease refill supplier 800 from FIG. 8A. In FIG. 8B, a cover 814 is indicated at a top 805 of the refill reservoir 802. In some examples, a cover 814 is removable to allow refilling of the refill reservoir 802. In the example shown, a tube 812 is included, and a follower disk 816. In operation, as the pump 804 is actuated, grease is drawn into the tube 812 at a bottom 803 of the refill reservoir 802. As grease is removed from the bottom 803 of the refill reservoir 802, the follower disk 816 is drawn downwards by suction as indicated by arrow 820. The inclusion of the follower disk facilitates even distribution of the grease as the level of grease decreases, and prevents one side of the grease in the refill reservoir 802 from draining early and forming an undesirable air pocket.

In refillable examples, the cover 814 is removed, and the tube 812 and follower disk 816 are removed from the refill reservoir 802. Grease can then be added to the refill reservoir 802, and the follower disk can be reset to the top 805 location. The tube 812 is then reinserted into the grease reservoir 802, and the cover 814 is replaced.

To better illustrate the method and apparatuses disclosed herein, a non-limiting list of embodiments is provided here:

Example 1 includes a drill stem grease injector. The injector includes an injection chamber, a piston within the injection chamber, wherein the piston is configured to push an amount of grease from the injection chamber onto a drill stem thread, and a grease port in a side of the injection chamber, wherein grease port is configured to actuate before motion of the piston during an injection operation.

Example 2 includes the drill stem grease injector of example 1, wherein the piston and the grease port are actuated by a single actuator.

Example 3 includes the drill stem grease injector of any one of examples 1-2, wherein the single actuator is a hydraulic actuator.

Example 4 includes the drill stem grease injector of any one of examples 1-3, wherein the injection chamber includes a first cylinder that includes a first opening in a side, and wherein the grease port includes a second cylinder with a second opening wherein the second cylinder slides to align the second opening with the first opening to open the grease port.

Example 5 includes the drill stem grease injector of any one of examples 1-4, wherein the second cylinder includes a ledge to actuate the piston after actuating the grease port.

Example 6 includes the drill stem grease injector of any one of examples 1-5, wherein the ledge is configured to actuate the piston to dispense grease after the grease port is closed, and wherein the ledge is configured to actuate the piston to a reset position after the grease port is open.

Example 7 includes a directional drill. The directional drill includes a drive motor mounted on a sliding carriage, the sliding carriage adapted to move back and forth on a drill frame, a drill stem vice located at a front end of the drill frame, and a grease reservoir. A drill stem grease injector, is included, the injector having an injection chamber coupled to the grease reservoir, a piston within the injection chamber, wherein the piston is configured to push an amount of grease from the injection chamber onto a drill stem thread, and a grease port in a side of the injection chamber, wherein grease port is configured to actuate open or closed before motion of the piston during an injection operation.

Example 8 includes the directional drill of example 7, wherein the drill stem grease injector is located within the grease reservoir.

Example 9 includes the directional drill of any one of examples 7-8, wherein the grease reservoir includes a hopper.

Example 10 includes the directional drill of any one of examples 7-9, wherein the grease reservoir includes a grease canister housing.

Example 11 includes the directional drill of any one of examples 7-10, further including a refill port coupled to the grease reservoir.

Example 12 includes the directional drill of any one of examples 7-11, wherein the piston and the grease port are actuated by a single actuator.

Example 13 includes the directional drill of any one of examples 7-12, wherein the single actuator is a hydraulic actuator.

Example 14 includes the directional drill of any one of examples 7-13, wherein the injection chamber includes a first opening in a side, and wherein the grease port includes a cylinder with a second opening wherein the cylinder slides to align the second opening with the first opening to open the grease port.

Example 15 includes the directional drill of any one of examples 7-14, wherein the cylinder includes a ledge to actuate the piston after actuating the grease port.

Example 16 includes the directional drill of any one of examples 7-15, wherein the ledge is configured to actuate the piston to dispense grease after the grease port is closed, and wherein the ledge is configured to actuate the piston to a reset position after the grease port is open.

Example 17 includes a drill stem grease system. The system includes a grease reservoir and a drill stem grease injector. The injector includes an injection chamber coupled to the grease reservoir, a piston within the injection chamber, wherein the piston is configured to push an amount of grease from the injection chamber onto a drill stem thread, and a grease port in a side of the injection chamber, wherein grease port is configured to actuate open or closed before motion of the piston during an injection operation. The system includes a refill passage coupled to the grease reservoir.

Example 18 includes the drill stem grease system of example 17, wherein the drill stem grease injector is located within the reservoir.

Example 19 includes the drill stem grease system of any one of examples 17-18, wherein the reservoir includes a grease canister housing.

Example 20 includes the drill stem grease system of any one of examples 17-19, wherein the grease canister housing includes a spring loaded piston.

Example 21 includes the drill stem grease system of any one of examples 17-20, wherein the grease canister housing is coupled to the refill passage, and further including a refill port coupled to the refill passage separate from the grease canister housing.

Example 22 includes a method of injecting grease onto threads of a drill stem. The method includes placing a drill stem thread adjacent to a grease injector, closing a grease port on a side of an injection chamber using a single actuator, actuating a piston within the injection chamber with the single actuator after the grease port is closed, opening the grease port with the single actuator before the piston is in a reset position, and returning the piston to the reset position with the single actuator after opening the grease port.

Example 23 includes the method of example 22, wherein placing the drill stem thread adjacent to the grease injector includes placing a sub saver thread adjacent to the grease injector.

Example 24 includes the method of any one of examples 22-23, wherein closing the grease port and opening the grease port includes sliding a cylinder back and forth over the injection chamber to align and dis-align corresponding openings in the injection chamber and the cylinder.

Example 25 includes the method of any one of examples 22-24, wherein actuating the piston includes pulling and pushing the piston with a ledge portion of the cylinder.

Example 26 includes a drill stem grease system. The system includes a grease reservoir and a drill stem grease injector. The injector includes an injection chamber coupled to the grease reservoir, and a piston within the injection chamber, wherein the piston is configured to push an amount of grease from the injection chamber onto a drill stem thread, and a refill passage coupled to the grease reservoir. The system further includes a grease refill supplier. The supplier includes a refill reservoir sized to hold multiple refill amounts of grease for the grease reservoir. The supplier also includes a refill pump, a refill pump actuator coupled to the refill pump, a refill hose coupled to an outlet of the refill pump, and a fitting on a distal end of the refill hose configured to connect to the refill passage.

Example 27 includes the drill stem grease system of example 26, further including a grease port in a side of the injection chamber, wherein grease port is configured to actuate open or closed before motion of the piston during an injection operation.

Example 28 includes the drill stem grease system of any one of examples 26-27, wherein the refill reservoir is cylindrical in shape, and the refill pump is located outside the refill reservoir.

Example 29 includes the drill stem grease system of any one of examples 26-28, further including a tube inlet coupled to the refill pump, wherein a distal end of the tube inlet is located adjacent to a bottom of the refill reservoir.

Example 30 includes the drill stem grease system of any one of examples 26-29, further including a follower adapted to move downward within the refill reservoir as grease is pumped out through the refill hose.

Example 31 includes the drill stem grease system of any one of examples 26-30, wherein the fitting includes a threaded fitting.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

The foregoing description, for the purpose of explanation, has been described with reference to specific example embodiments. However, the illustrative discussions above are not intended to be exhaustive or to limit the possible example embodiments to the precise forms disclosed. Many modifications and variations are possible in view of the above teachings. The example embodiments were chosen and described in order to best explain the principles involved and their practical applications, to thereby enable others skilled in the art to best utilize the various example embodiments with various modifications as are suited to the particular use contemplated.

It will also be understood that, although the terms "first," "second," and so forth may be used herein to describe various elements, these elements should not be limited by these terms. These terms are only used to distinguish one element from another. For example, a first contact could be termed a second contact, and, similarly, a second contact could be termed a first contact, without departing from the scope of the present example embodiments. The first contact and the second contact are both contacts, but they are not the same contact.

The terminology used in the description of the example embodiments herein is for the purpose of describing particular example embodiments only and is not intended to be limiting. As used in the description of the example embodiments and the appended examples, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The invention claimed is:

1. A drill stem grease system, comprising:
a grease reservoir;
a drill stem grease injector, including:
an injection chamber;
a piston within the injection chamber, wherein the piston is configured to push an amount of grease from the injection chamber onto a drill stem thread;
a grease port in a side of the injection chamber, the grease port including a first opening, wherein the grease port is coupled to the grease reservoir;
a cylinder over the injection chamber, wherein the cylinder includes a second opening wherein the cylinder slides to align the second opening with the first opening to open the grease port.

2. The drill stem grease system of claim 1, wherein the grease port is configured to actuate open or closed before motion of the piston during an injection operation.

3. The drill stem grease system of claim 1, further including a refill passage coupled to the grease reservoir.

4. The drill stem grease system of claim 1, wherein the injector is located within the grease reservoir.

5. The drill stem grease system of claim 1, wherein the reservoir includes a grease cannister housing.

6. The drill stem grease system of claim 5, wherein the grease cannister housing includes a spring loaded piston.

7. The drill stem grease system of claim 1, wherein the grease reservoir is located to gravity feed to the grease port.

8. The drill stem grease system of claim 1, wherein the injector is oriented vertically with an exit port on top of the injector.

9. The drill stem grease system of claim 1, wherein the injector is oriented horizontally with an exit port on a side of the injector.

10. The drill stem grease system of claim 1, wherein the cylinder includes a ledge to actuate the piston.

11. A drill stem grease system, comprising:
a grease reservoir;
a drill stem grease injector, including:
an injection chamber;
a piston within the injection chamber, wherein the piston is configured to push an amount of grease from the injection chamber onto a drill stem thread;
a grease port in a side of the injection chamber, the grease port including a first opening, wherein the grease port is connected to the grease reservoir;
a cylinder over the injection chamber, wherein the cylinder includes a second opening wherein the cylinder slides to align the second opening with the first opening to open the grease port;
wherein the grease port and the piston are both actuated by motion of the cylinder during a greasing cycle.

12. The drill stem grease system of claim 11, wherein the grease port is configured to actuate open or closed before motion of the piston during an injection portion of the greasing cycle.

13. The drill stem grease system of claim 11, further including a magnet to hold the piston in place for a portion of the greasing cycle.

14. The drill stem grease system of claim 11, further including a first piston spring to bias the piston in a location that blocks the grease port during a portion of the greasing cycle.

15. The drill stem grease system of claim 11, further including a second piston spring coupled to the piston the second piston spring configured to absorb contact force during a resetting phase of the greasing cycle.

16. The drill stem grease system of claim 15, wherein the second piston spring includes a Belleville washer spring.

17. The drill stem grease system of claim 11, further including one or more guide rods to guide motion of the cylinder.

18. The drill stem grease system of claim 17, further including one or more return springs located on the one or more guide rods to provide a return force on the cylinder.

* * * * *